US006695473B2

(12) United States Patent
Unger et al.

(10) Patent No.: US 6,695,473 B2
(45) Date of Patent: Feb. 24, 2004

(54) DIAGNOSTIC SYSTEM AND METHOD FOR A MOTOR VEHICLE

(75) Inventors: Anders Unger, Ravlanda (SE); Peter Claes Alleving, Alingsas (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/063,964

(22) Filed: May 30, 2002

(65) Prior Publication Data

US 2003/0223473 A1 Dec. 4, 2003

(51) Int. Cl.[7] ..... G01K 1/08
(52) U.S. Cl. ..... 374/145; 73/118.1
(58) Field of Search ..... 374/144, 145, 374/146, 141; 73/118.1, 119 R; 60/274, 277; 701/32

(56) References Cited

U.S. PATENT DOCUMENTS

| | | | | |
|---|---|---|---|---|
| 3,882,451 | A | * 5/1975 | Fujishiro et al. | 374/144 |
| 4,975,846 | A | * 12/1990 | Abe et al. | 701/32 |
| 5,255,511 | A | * 10/1993 | Maus et al. | 374/144 |
| 5,390,490 | A | * 2/1995 | Brooks | 60/277 |
| 5,526,871 | A | * 6/1996 | Musser et al. | 374/145 |
| 5,711,071 | A | 1/1998 | Fromson et al. | |
| 5,732,549 | A | * 3/1998 | Treinies et al. | 60/274 |
| 5,997,831 | A | 12/1999 | Dettling et al. | |
| 6,050,087 | A | * 4/2000 | Kurihara et al. | 374/144 |
| 6,092,413 | A | * 7/2000 | Busch et al. | 73/118.1 |
| 6,190,627 | B1 | 2/2001 | Hoke et al. | |
| 6,200,542 | B1 | 3/2001 | Poles et al. | |
| 6,212,882 | B1 | 4/2001 | Gregor et al. | |
| 6,214,303 | B1 | 4/2001 | Hoke et al. | |
| 6,506,605 | B1 | * 1/2003 | Allen et al. | 436/37 |
| 2001/0019707 | A1 | 9/2001 | Okayama et al. | |
| 2001/0039928 | A1 | * 11/2001 | Alleving et al. | 123/41.49 |
| 2002/0000088 | A1 | * 1/2002 | Alleving et al. | 60/277 |

FOREIGN PATENT DOCUMENTS

| | | |
|---|---|---|
| DE | 44 26 494 A1 | 2/1996 |
| EP | 1 153 646 A | 11/2001 |

OTHER PUBLICATIONS

Hugel et al., Derwent–Acc–No: 1996–088237, English Language ABSTRACT of DE 4426494A, (1996).*

* cited by examiner

*Primary Examiner*—Diego Gutierrez
*Assistant Examiner*—Stanley J. Pruchnic, Jr.
(74) *Attorney, Agent, or Firm*—Mark S. Sparschu

(57) ABSTRACT

A diagnostic system for a motor vehicle comprises a component installed within motor vehicle. The system further includes an identifier device mechanically coupled to the component. The identifier device comprises an identifying portion which identifies the component, and the identifier device also comprises a sensor which senses the physical environment in which the identifier device is located. A diagnostic method for a motor vehicle comprises mounting a component within the motor vehicle. The method further includes mechanically coupling an identifier device to the component, the identifier device comprising an identifying portion which identifies the component and the identifier device also including a sensor. The method also comprises confirming, with data provided by the identifying portion, that the identifying portion correctly corresponds to the component. Further, the method includes confirming, with data provided by the sensor, that the identifier device is properly coupled to the component.

25 Claims, 2 Drawing Sheets

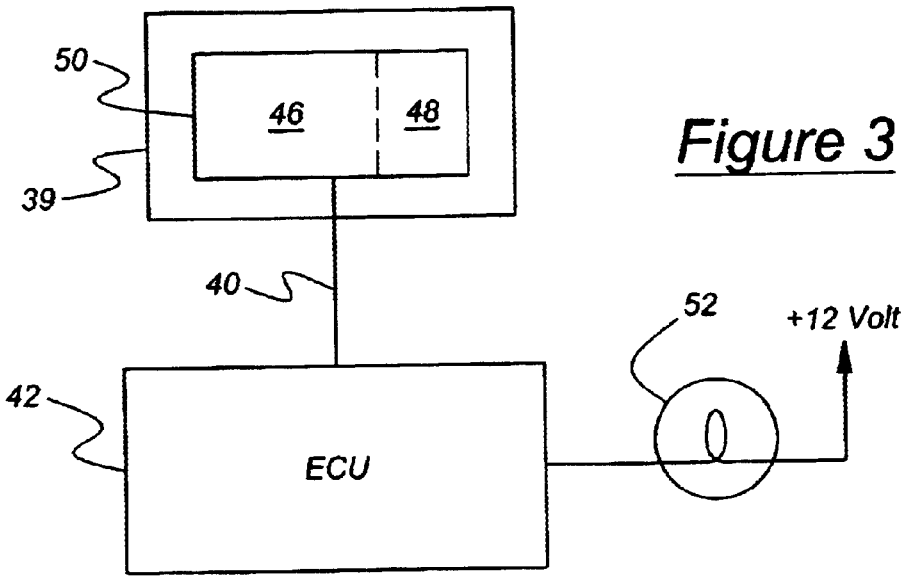
Figure 3
Figure 4
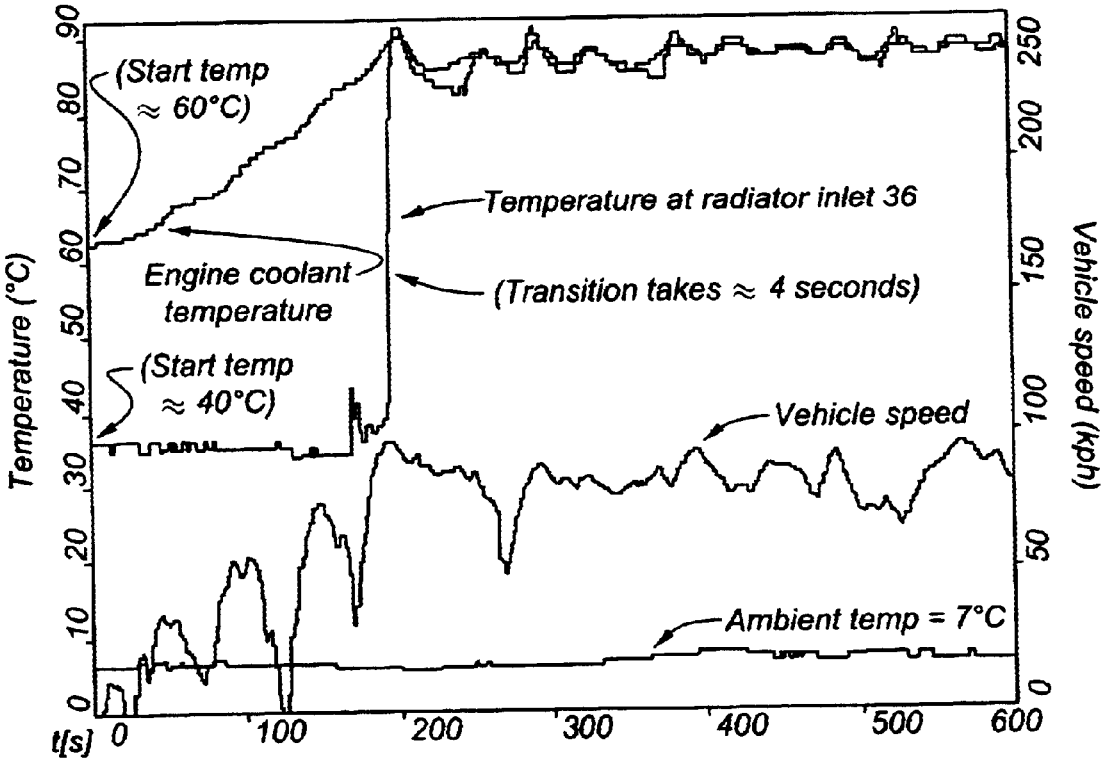

DIAGNOSTIC SYSTEM AND METHOD FOR A MOTOR VEHICLE

BACKGROUND OF THE INVENTION

1. Field of the Invention

The present invention relates to diagnostic systems and methods for motor vehicles.

2. Background of the Related Art

In the motor vehicle field, it is known that interchangeable parts are often used, wherein different variants of a component may have the same mounting provisions. While this of course has advantages in terms of cost efficiency, it can also raise an issue. Specifically, where one variant of a part has certain unique functionality not shared by its like-mounted brethren, installing the incorrect part may have adverse consequences on one or more functions of the vehicle.

This can be an issue in the case of vehicle components which play a role in improving air quality. For example, radiator assemblies for motor vehicles, where the radiator assembly is coated with a catalytic material for converting environmentally harmful substances in ambient air during the utilization of the motor vehicle, are well known. The purpose of this catalytic coating is to utilize the vehicle for improving the environment by cleaning ambient air. Such a coated radiator assembly is likely to have the same mounting provisions as similar radiator assemblies which are not coated and therefore do not have the property of converting the environmentally-harmful substances in ambient air. This is because not all jurisdictions in which a vehicle is sold may require such property, or because some (but not necessarily all) jurisdictions may give exhaust emission "credits" for vehicles with such property. Because a coated radiator will, naturally, cost more than an uncoated one, vehicles built with uncoated radiators will likely be sold in some jurisdictions. Further, uncoated radiators will certainly be made available for aftermarket installation as spare parts in such jurisdictions.

Where a jurisdiction requires an air-cleaning radiator or gives emission "credits" for such a radiator, the jurisdiction is also likely to require that a diagnostic function be provided to assure that the coated radiator, as opposed to an uncoated radiator without the air-cleaning function, is installed on the vehicle. Assuring with a very high degree of probability that the proper radiator is installed on the vehicle can be very challenging.

SUMMARY OF INVENTION

It is therefore an object of the present invention to provide a diagnostic system and method which can reliably detect whether a proper component is installed in a motor vehicle.

The present invention provides a diagnostic system for a motor vehicle. The system comprises a component installed within motor vehicle. The system further includes an identifier device mechanically coupled to the component. The identifier device comprises an identifying portion which identifies the component, and the identifier device also comprises a sensor which senses the physical environment in which the identifier device is located.

The present invention also provides a diagnostic method for a motor vehicle. The method comprises mounting a component within the motor vehicle. The method further includes mechanically coupling an identifier device to the component, the identifier device comprising an identifying portion which identifies the component and the identifier device also including a sensor. The method also comprises confirming, with data provided by the identifying portion, that the identifying portion correctly corresponds to the component. Further, the method includes confirming, with data provided by the sensor, that the identifier device is properly coupled to the component.

Diagnostic systems and methods according to the present invention are highly advantageous in that they allow, with high reliability, detection that a proper component is installed in a motor vehicle.

BRIEF DESCRIPTION OF DRAWINGS

FIG. 3 illustrates with greater detail identifying device 39 and its interconnection with ECU 42.

FIG. 4 is a graph including the temperature signature near the inlet 36 of radiator 16 when thermostat 20 opens to allow coolant flow into radiator 16.

DETAILED DESCRIPTION

Figure 1:
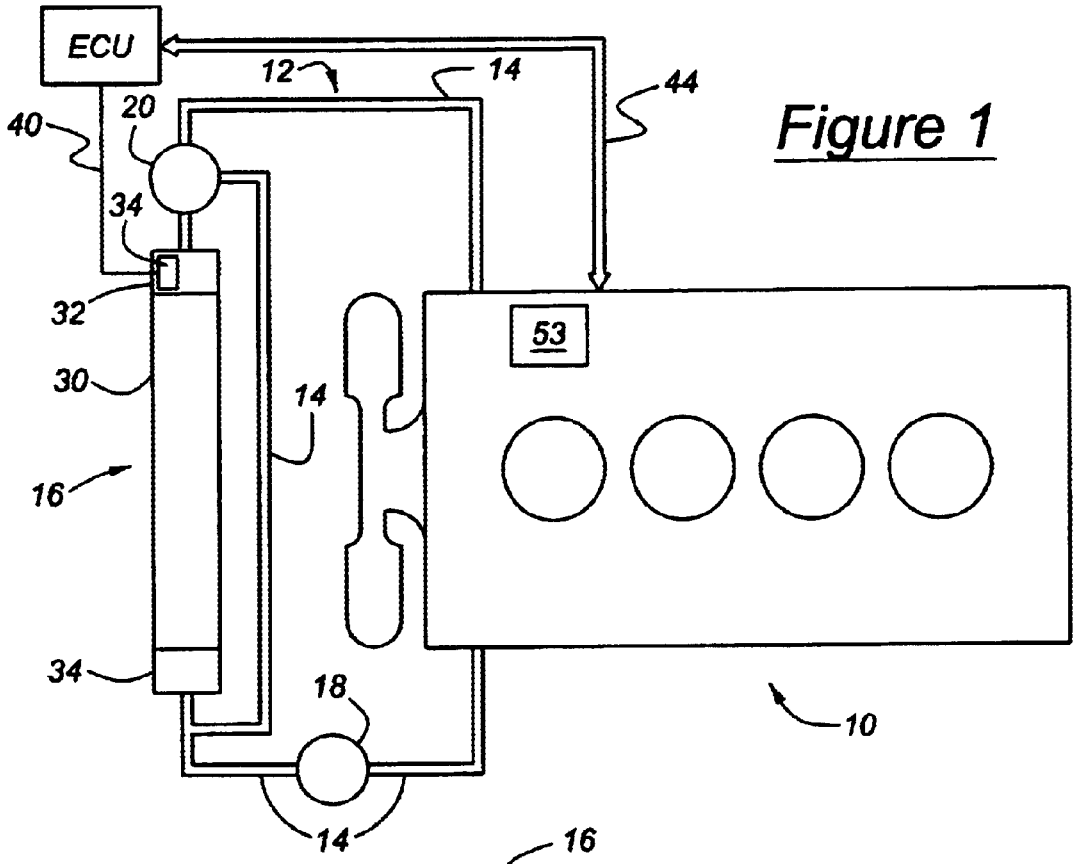
FIG. 1 is a schematic drawing of an engine 10 and associated cooling system and control componentry, according to one embodiment of the present invention.

Referring to FIG. 1, a schematic of an engine 10 for a motor vehicle in accordance with a preferred embodiment of the present invention is illustrated. In this embodiment, engine 10 is a conventional combustion engine. A cooling circuit 12 is fitted to the engine 10. The cooling circuit 12 is of a conventional type and comprises cooling channels 14, a radiator 16, a coolant pump 18, and a thermostat valve 20. The cooling channels 14 are connected to cooling channels (not shown) in the engine 10. The radiator 16 emits heat to the environment. The coolant pump 18 pumps the coolant in the cooling circuit 12. The thermostat valve 20 opens and closes the flow of the coolant through the radiator 16, allowing the coolant to bypass radiator 16 into a parallel channel if the coolant temperature is below a predetermined threshold (approximately 90° C. in many typical engines).

Figure 2:
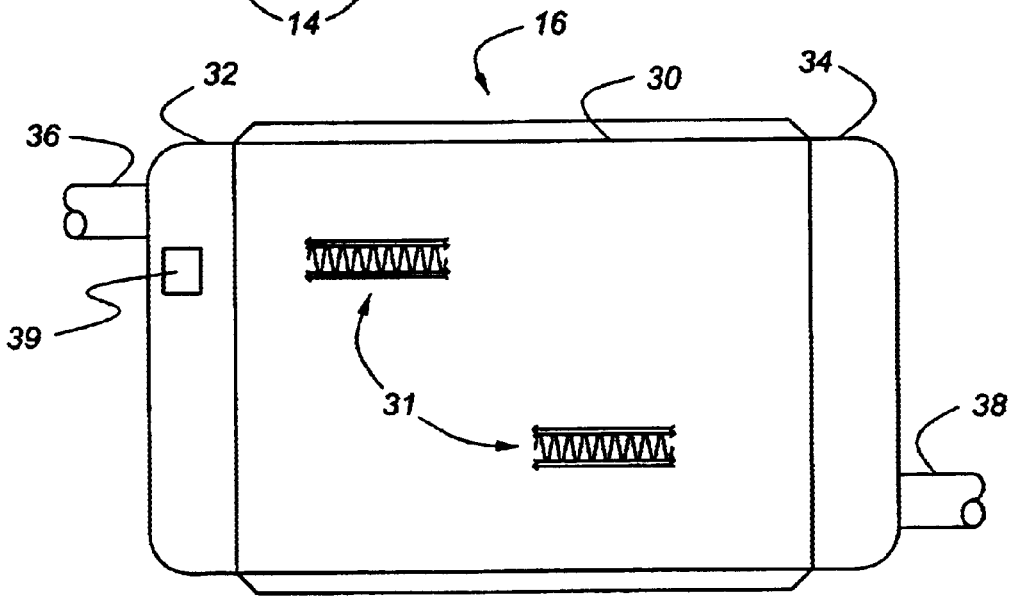
FIG. 2 illustrates radiator 16 and identifying device 39 of FIG. 1.

Referring additionally to FIG. 2, radiator 16 further comprises a main section 30, from which the heat in the coolant is expelled to the environment. Main section 30 typically comprises parallel flattened metal tubes through which the coolant flows, mechanically coupled with metal fins to enhance the amount of heat which is expelled from the coolant to the environment. Representative portions of such tubes and fins are depicted with reference number 31 in FIG. 2. Radiator 16 also includes inlet tank 32 and outlet tank 34, each of which is affixed to an end of main section 30. Inlet tank 32 and outlet tank 34 are each preferably molded of plastic. Inlet tank 32 includes coolant inlet 36, into which coolant flows from cooling circuit 12, and outlet tank 34 includes coolant outlet 38, out of which coolant flows back into cooling circuit 12 after having flowed through main section 30 to expel heat.

The coolant channels in main section 30 of radiator 16 are at least partially coated with a catalytic material, a practice which is well-known in the art. The catalytic material is designed to convert an environmentally-harmful substance into one or more substances which are non-harmful to the environment, aided in this function by the heat of the coolant flowing in main section 30 of radiator 16. Examples of environmentally harmful substances which may be so converted include particles, ozone, carbon monoxide, nitrous oxide, VOC, HC, NMOG, $NO_x$, $SO_2$ and methane. Radiator 16 thus has a function to improve air quality. (The term "improve air quality" applies also in this application to components which have a role in reducing exhaust emissions from the vehicle.)

Coupled to radiator 30, preferably by molding into plastic inlet tank 32 near inlet 36, is an identification device 39 which will be described further below. Identification device 39 is coupled by a communication channel, preferably a serial data bus 40, to an electronic control unit (ECU) 42. Rather than a data bus, appropriate numbers of conductors or wires can be used as well.

In this embodiment of the present invention, ECU 42 is included in the engine control system for engine 10 and performs the numerous engine control functions performed by engine controllers. ECU 42 is therefore coupled to numerous sensors and actuators associated with engine 10 via bus(es) and/or conductor(s) 44. As discussed above, ECU 42 is also communicatively coupled to identification device 39 and performs a diagnostic function related to determining whether a catalytically-coated radiator 16 is installed in the vehicle. (Due to the ready availability of data networks in modern vehicles, the diagnostic function can also be performed by another module than the engine controller or distributed among a number of controllers which together form a virtual diagnostic "device", with data readily shared via data networks on the vehicle.)

Refer now additionally to FIG. 3. Identification device 39 preferably includes two functional sections which are permanently coupled within identification device 39. The first section 46 is an identifier which identifies radiator 16 as a radiator which is catalytically coated, as opposed to one which is interchangeable in the vehicle, but which is not catalytically coated. Second section 48 is a sensor which senses whether identification device 39 is actually installed in its appointed location (that is in this case, near inlet 36 to inlet tank 32). Preferably, this sensor is a sensor which senses the physical environment in the immediate vicinity of identification device 39. More preferably, second section 48 is a temperature sensor and yet more preferably a temperature sensor of the simple thermistor type, well-known in the art to be very reliable.

The functions of first section 46 and second section 48 of identification device 39 can, of course, be realized in several ways. In this embodiment of the present invention, first section 46 and second section 48 are realized within an integrated circuit 50 which includes low-speed serial data capability with bus 40. Preferably, this integrated circuit 50 is a so-called local-interface network (LIN) chip, which is an integrated circuit having low-speed aerial data communication capability and relatively low cost.

In practice, ECU 42 periodically interrogates identification device 39 via bus 40 to ask whether radiator 16 is a catalytically-coated radiator. Identification device 39 (via first portion 46) will in turn answer this question by responding with the unique identification code assigned to catalytically-coated radiators. If identification device 39 does not reply to the interrogation with the appropriate answer, ECU 42 will conclude that the radiator in the vehicle is not a catalytically-coated radiator. ECU 42 will then take appropriate action, such as setting a malfunction code in its internal memory and/or lighting a malfunction indicator lamp 52.

However, ECU 42 receiving a correct answer to its interrogation does not necessarily assure the radiator is a catalytically-coated radiator. Because non-coated radiators are significantly less costly than coated radiators, and because non-coated radiators will be available as replacement parts intended for jurisdictions where radiators are not required and/or do not receive emission "credits", there will be a significant incentive for creative measures to "trick" ECU 42 into thinking that an uncoated radiator which has been installed as a repair part is in fact a catalytically-coated one. One such creative measure could be to acquire an identification device 39 which has not been mounted into a radiator 16, or one which has been removed from a catalytically-coated radiator 16, and simply plug it into the connector intended for connection of identification device 39. In such case, without additional countermeasures, ECU 42 would interrogate the identification device 39, which would in turn respond that a coated radiator is installed in the vehicle (when in fact a non-coated radiator has been installed).

Second section 48 of identification device 39 prevents this level of "cheating". Second section 48, preferably being a temperature sensor, senses the temperature in the immediate vicinity of identification device 39. It has been observed by the inventors that at the inlet to radiator 16, the temperature exhibits a very characteristic signature when thermostat 20 opens and allows coolant to flow into radiator 16. This signature is illustrated in FIG. 4. As illustrated there, the temperature at the inlet to the radiator 16 makes a very substantial jump from a temperature approximately that of the engine compartment of the vehicle (approximately 40° C. in FIG. 4) to approximately 90° C. (the temperature at which thermostat 20 is designed to open) in a short time, approximately four seconds in the test plot shown in FIG. 4. ECU 42 can interrogate identification device 39 on a periodic basis and watch for this characteristic jump in temperature. If the characteristic jump is not seen during a number of warming-up events of the vehicle, ECU 42 will conclude that a catalytically-coated radiator 16 is not in fact installed in the vehicle. ECU 42 will then take appropriate measures to indicate this fault, including setting a malfunction code in its internal memory and/or lighting malfunction indicator lamp 52.

It can also be seen from FIG. 4 that the temperature near inlet 36 to radiator 16 will closely correspond to the engine coolant temperature after the characteristic jump mentioned in the foregoing paragraph occurs, and thereafter until coolant ceases to flow in radiator 16. This relationship (that is, the close correspondence of temperatures between the engine coolant and the inlet to the radiator after coolant begins to flow in the radiator) can also be used as a way to sense whether identification device 39 is actually properly-installed in the radiator 16. The engine coolant temperature is readily available in that it is already sensed outside radiator 16, typically within engine 10, for various engine control purposes. A coolant temperature sensor 53 is shown schematically in FIG. 1.

Because first section 46 and second section 48 are realized on a common integrated circuit which is mounted on a substrate or circuit board, they can be said to be "permanently" coupled together and "permanently" coupled within identification device 39. "Permanent" coupling in this context means that such coupling cannot practically be undone and the respective components still function properly. It is desirable for first section 46 and second section 48 to each be permanently coupled within identification device 39 to minimize chances of "cheating". Such "permanent" coupling can also be attained, for example, by first section 46 and second section 48 being located on a common substrate, though not necessarily integrated into the same integrated circuit.

The invention is not limited to the above-described embodiments, but may be varied within the scope of the following claims.

What is claimed is:

1. A diagnostic system for a motor vehicle, said system comprising:

a component installed within said motor vehicle;

an identifier device mechanically coupled to said component;

said identifier device comprising an electrical identifying portion which identifies said component and said identifier device also comprising a sensor which senses the physical environment in which said identifier device is located;

wherein said component is a radiator.

2. A diagnostic system as recited in claim 1, wherein said radiator has an air-quality-improvement function during functioning of the motor vehicle.

3. A diagnostic system as recited in claim 1, wherein said radiator is coated with a catalytic coating to convert harmful substances in ambient air.

4. A diagnostic system as recited in claim 1, further comprising a diagnostic device coupled in communication with said identifying portion to confirm that said identifying portion correctly corresponds to said component.

5. A diagnostic system as recited in claim 4, wherein:

said diagnostic device is coupled in communication with said sensor; and said diagnostic device flags a malfunction if said sensor exhibits behavior inconsistent with the location in which said identifier device is intended to be coupled.

6. A diagnostic system as recited in claim 5, wherein said sensor is a temperature sensor.

7. A diagnostic system as recited in claim 6, wherein said inconsistent behavior is a lack of a signal shift from said temperature sensor characteristic of coolant flow beginning in said radiator.

8. A diagnostic system as recited in claim 6, wherein said inconsistent behavior is a lack of proper correspondence between a coolant temperature measured by a coolant temperature sensor located outside said radiator and a temperature of coolant flowing in said radiator as sensed by said temperature sensor.

9. A diagnostic system as recited in claim 5, wherein said communication comprises electrical communication between said identifier device and said diagnostic device.

10. A diagnostic system as recited in claim 5, wherein said communication comprises serial data communication between said identifier device and said diagnostic device.

11. A diagnostic system as recited in claim 4, wherein said communication comprises electrical communication between said identifier device and said diagnostic device.

12. A diagnostic system as recited in claim 4, wherein said communication comprises serial data communication between said identifier device and said diagnostic device.

13. A diagnostic system as recited in claim 1, wherein said sensor is a temperature sensor.

14. A diagnostic system as recited in claim 1, wherein said identifier portion and said sensor are located on a common integrated circuit.

15. A diagnostic system as recited in claim 1, wherein said identifier portion and said sensor are located on a common substrate.

16. A diagnostic method for a motor vehicle, said method comprising:

mounting a component within said motor vehicle;

mechanically coupling an identifier device to said component, said identifier device comprising an electrical identifying portion which identifies said component and said identifier device also including a sensor; and confirming, with data provided by said identifying portion, that said identifying portion correctly corresponds to said component; and confirming, with data provided by said sensor, that said identifier device is properly coupled to said component;

wherein said component is a radiator.

17. A diagnostic method as recited in claim 16, wherein said component has an air-quality-improvement function during functioning of the motor vehicle.

18. A diagnostic method as recited in claim 17, wherein said radiator is coated with a catalytic coating to convert harmful substances in ambient air.

19. A diagnostic method as recited in claim 17, wherein said step of confirming that said identifier device is properly coupled to said component further comprises:

confirming that said sensor exhibits behavior proper for the location in which said identifying device is intended to be coupled.

20. A diagnostic method as recited in claim 19, wherein said sensor is a temperature sensor.

21. A diagnostic method as recited in claim 16, wherein said data provided by said identifying portion comprises an identification code assigned to said component.

22. A diagnostic method for a motor vehicle, said method comprising:

mounting a component within said motor vehicle;

mechanically coupling an identifier device to said component, said identifier device comprising an identifying portion which identifies said component and said identifier device also including a sensor; and confirming, with data provided by said identifying portion, that said identifying portion correctly corresponds to said component;

confirming, with data provided by said sensor, that said identifier device is properly coupled to said component;

wherein said component has an air-guality-improvement function during functioning of the motor vehicle;

wherein said step of confirming that said identifier device is properly coupled to said component further comprises confirming that said sensor exhibits behavior proper for the location in which said identifying device is intended to be coupled;

wherein said step of confirming that said sensor exhibits behavior proper for the location in which said identifying device is intended to be coupled further comprises the step of:

monitoring said temperature sensor for a signal shift characteristic of coolant flow beginning in said component.

23. A diagnostic method as recited in claim 22, wherein said component is a radiator.

24. A diagnostic method for a motor vehicle, said method comprising:

mounting a component within said motor vehicle;

mechanically coupling an identifier device to said component, said identifier device comprising an identifying portion which identifies said component and said identifier device also including a sensor; and confirming, with data provided by said identifying portion, that said identifying portion correctly corresponds to said component;

confirming, with data provided by said sensor, that said identifier device is properly coupled to said component;

wherein said component has an air-quality-improvement function during functioning of the motor vehicle;

wherein said step of confirming that said identifier device is properly coupled to said component further comprises confirming that said sensor exhibits behavior proper for the location in which said identifying device is intended to be coupled;

wherein said step of confirming that said sensor exhibits behavior proper for the location in which said identifying device is intended to be coupled further comprises the step of:

monitoring said temperature sensor for correspondence between a coolant temperature measured by an engine coolant temperature sensor located outside said component and a temperature of coolant flowing in said component as sensed by said temperature sensor.

25. A diagnostic method as recited in claim 24, wherein said component is a radiator.

* * * * *